US012364336B2

(12) United States Patent
Zhao et al.

(10) Patent No.: US 12,364,336 B2
(45) Date of Patent: Jul. 22, 2025

(54) MECHANICAL EXTENSION DEVICE OF ROCKING SEAT

(71) Applicant: Emomo Technology (Zhejiang) Co., Ltd., Huzhou (CN)

(72) Inventors: Yushu Zhao, Huzhou (CN); Wencai Li, Huzhou (CN); Kai Jin, Huzhou (CN)

(73) Assignee: Emomo Technology (Zhejiang) Co., Ltd., Huzhou (CN)

( * ) Notice: Subject to any disclaimer, the term of this patent is extended or adjusted under 35 U.S.C. 154(b) by 221 days.

(21) Appl. No.: 18/237,413

(22) Filed: Aug. 24, 2023

(65) Prior Publication Data

US 2024/0341478 A1 Oct. 17, 2024

Related U.S. Application Data

(63) Continuation of application No. PCT/CN2023/110579, filed on Aug. 1, 2023.

(30) Foreign Application Priority Data

Apr. 12, 2023 (CN) ..... 202310413669.2

(51) Int. Cl.
*A47C 3/03* (2006.01)
*A47C 1/034* (2006.01)
(Continued)

(52) U.S. Cl.
CPC ..... *A47C 1/0345* (2013.01); *A47C 3/0251* (2018.08); *A47C 3/03* (2013.01); *A47C 3/18* (2013.01)

(58) Field of Classification Search
CPC ..... A47C 3/0251; A47C 3/0255; A47C 3/03
See application file for complete search history.

(56) References Cited

U.S. PATENT DOCUMENTS 4,591,205 A * 5/1986 James ..... A47C 1/0345 248/188.8
2006/0290174 A1 12/2006 Hoffman et al.
(Continued)

FOREIGN PATENT DOCUMENTS

CN 107157165 A * 9/2017 ..... A47C 3/0255
CN 108477888 A * 9/2018 ..... A47C 17/04
(Continued)

*Primary Examiner* — Timothy J Brindley
(74) *Attorney, Agent, or Firm* — Bayramoglu Law Offices LLC

(57) ABSTRACT

A mechanical extension device of a swinging seat is provided, which includes a base, a first swinging rod, a second swinging rod, an actuator and two mechanical extension units, where the base is connected to the first swinging rod and the second swinging rod in a rotating way; the actuator is arranged between the two mechanical extension units; a locking device is arranged on a second connecting rod connected to the second swinging rod in the mechanical extension unit in a rotating mode, a guide groove and a locking groove formed in the guide groove are formed in the base, the guide groove is opened towards one side, the locking device can enter the guide groove from the opened position of the guide groove, and when the locking device swings and moves the mechanical extension unit, the locking device can enter the locking groove and swing relative to the base.

10 Claims, 11 Drawing Sheets

(51) Int. Cl.
*A47C 3/025* (2006.01)
*A47C 3/18* (2006.01)

(56) References Cited

U.S. PATENT DOCUMENTS

| | | | | |
|---|---|---|---|---|
| 2018/0206644 | A1* | 7/2018 | Murphy | A47C 3/18 |
| 2022/0015543 | A1* | 1/2022 | Bryant | A47C 1/0242 |
| 2022/0361674 | A1* | 11/2022 | Li | A47C 1/0352 |
| 2022/0400863 | A1* | 12/2022 | Murphy | A47C 1/0242 |
| 2024/0122347 | A1* | 4/2024 | Forgy | A47C 3/0251 |

FOREIGN PATENT DOCUMENTS

| | | | | | |
|---|---|---|---|---|---|
| CN | 113142861 | A | | 7/2021 | |
| CN | 113509017 | A | | 10/2021 | |
| CN | 218074230 | U | | 12/2022 | |
| CN | 116326946 | A | | 6/2023 | |
| CN | 117898566 | A | * | 4/2024 | A47C 3/0251 |
| JP | 2000152839 | A | | 6/2000 | |

* cited by examiner

MECHANICAL EXTENSION DEVICE OF ROCKING SEAT

CROSS REFERENCE TO THE RELATED APPLICATIONS

This application is a continuation application of International Application No. PCT/CN2023/110579, filed on Aug. 1, 2023, which is based upon and claims priority to Chinese Patent Application No. 202310413669.2, filed on Apr. 12, 2023, the entire contents of which are incorporated herein by reference.

TECHNICAL FIELD

The invention relates to the field of furniture, in particular to a mechanical extension device of a swinging seat.

BACKGROUND

With the improvement of productivity level and the development of social and economic level, the living standard of people is higher and higher, and the requirement on furniture is also higher and higher; the sofa, the rocking chair, the seat and the like in the furniture can be seen everywhere, and some sofas can also swing back and forth.

A variety of movable seating units are known in the art, such as rocking chairs, swinging chairs, sofas with a rocking function, etc., which have built-in mechanical extension devices, usually having a base, a backrest support, a seat support, a tilting mechanism, and being able to change between several different positions; in the mechanical extension device of the seat capable of swinging back and forth, a swinging mechanism for realizing a swinging function is further arranged, and compared with the common movable seat, the mechanical extension device provides more comfortable and novel sitting experience, so that the seat gradually falls down in the domestic market.

Such seats or sofas with a swinging function require a locking of the swinging movement in the lying position; however, in the existing swinging sofa, the limiting pin for locking the swinging motion cannot enter the limiting groove after the mechanical extension device swings, which means that the swinging and state switching cannot be performed simultaneously, and the swinging motion of the sofa in the lying state cannot be locked while swinging; and, the spacer pin can't get into the spacing groove, and the spacer pin can block in between other members of mechanical extension device, if continue to switch mechanical extension device state by force, just lead to member or spacer pin to damage easily, and then lead to mechanical extension device to break down, increase cost of maintenance.

SUMMARY

In order to solve the above technical problem, the present invention provides a mechanical extension device of a swing seat, including a base, a first swinging rod, a second swinging rod, an actuator and two mechanical extension units, wherein the base is rotatably connected to the first swinging rod and the second swinging rod, the mechanical extension unit is further rotatably connected to the first swinging rod and the second swinging rod, the mechanical extension unit is no longer directly rotatably connected to the base, and the first swinging rod and the second swinging rod are in transition between the two, so that the mechanical extension unit can swing relative to the base; the actuator is arranged between the two mechanical extension units and drives the two mechanical extension units to move, so that the mechanical extension device has the state switching capability; the locking device is arranged on a second connecting rod which is connected to the second swinging rod in the mechanical extension unit in a rotating mode, a guide groove and a locking groove formed in the guide groove are formed in the base, the guide groove is opened towards one side, the locking device can enter the guide groove from the opening position of the guide groove, and when the mechanical extension unit swings, the locking device can enter the locking groove in an unobstructed mode through the guide of the guide groove, the mechanical extension unit swings relative to the base under the locking lying posture state, and therefore the occurrence of faults is avoided.

The technical scheme of the invention is realized as follows:

a mechanical extension device of a swinging seat comprises a base, a first swinging rod, a second swinging rod, an actuator and two mechanical extension units which are arranged in bilateral symmetry, wherein the first swinging rod and the second swinging rod are connected to the base in a rotating mode, the two mechanical extension units are rotationally connected to the first swinging rod and the second swinging rod, and the first swinging rod and the second swinging rod are configured to enable the mechanical extension units to swing on the base; the actuator is arranged between the two mechanical extension units and drives the mechanical extension units to move; the mechanical extension unit comprises a linkage rod, a seat connector, a backrest connector, a leg rest connecting rod assembly, a first connecting rod and a second connecting rod, the footrest is installed on the leg rest connecting rod assembly, the leg rest connecting rod assembly is configured to extend under the action of an actuator and control the footrest to fold or extend, the leg rest connecting rod assembly is arranged at the front end part of the seat connector, and the backrest connector is arranged at the rear end part of the seat connector; the first connecting rod is rotationally connected to the first swinging rod, and the second connecting rod is rotationally connected to the second swinging rod, two ends of the linkage rod are respectively in rotary connection with the leg rest connecting rod assembly and the second connecting rod; the actuator is respectively connected to the seat connector and the leg rest connecting rod assembly in a rotating way and drives the seat connector and the leg rest connecting rod assembly to move relatively; a locking device is arranged on the second connecting rod, a guide groove with an open side is formed in the base, and a locking groove is formed in the path end point of the guide groove; the rocking chair is also provided with a sitting posture state for the human body to sit and a lying posture state for the human body to lie, and the leg rest connecting rod assembly is folded in front of the seat connector in the sitting posture state; when the sitting posture state is switched to the lying posture state, the leg rest connecting rod assembly is driven by the actuator to extend and the linkage rod drives the second connecting rod to move, the second connecting rod drives the backrest connector to tilt backwards, meanwhile, the locking device enters the guide groove from the open side of the guide groove and is guided to the locking groove by the guide groove, the mechanical extension unit and the base are locked to swing relatively, and the lying posture state is switched.

The mechanical extension units are not directly connected to the base in a rotating mode, but are arranged on the base in a swinging mode through the first swinging rod and the second swinging rod, and can swing back and forth relative to the base to improve the sitting feeling; because the actuator is arranged between the two mechanical extension units, under the condition that the actuator is locked, the rods of the two mechanical extension units cannot move, so that the mechanical extension units can integrally swing on the base under the condition that the movement of the mechanical extension units is not interfered, and the relative movement between the rods of the mechanical extension units cannot occur; one side of the guide groove is open, and even when the mechanical extension unit swings relative to the base, the locking device can still enter the locking groove in an unobstructed and guided manner, so that the condition of blocking or damaging the rod piece can be avoided, the occurrence of faults is avoided, and the maintenance cost is saved; the actuator is not connected to the base but to the seat link member and the leg rest link assembly, improving the driving efficiency.

Preferably, the guide groove is a V-shaped groove which is opened upwards, and the opening angle range of the V-shaped groove is 120-150 degrees. The opening of the guide groove is an obtuse angle with a larger angle, so that the guide groove has enough avoidance space for the locking device to move in the guide groove along with the swinging of the mechanical extension unit, and the movement of the locking device cannot be hindered.

Preferably, the groove wall of the guide groove is a guide surface, the guide surface is configured to swing relative to the base while the mechanical extension unit is driven by the actuator to move, and the locking device can still intermittently contact with the guide surface and approach the locking groove without obstruction. Firstly, under the condition that the mechanical extension unit does not swing, the locking device moves along a preset motion track under the preset configuration of each rod piece of the mechanical extension unit and can enter the locking groove without hindrance, and the locking device does not need the guide groove to play a role in guiding, which is the most basic requirement; when the mechanical extension unit swings, the locking device swings along with the mechanical extension unit and does not move along a set movement track any more, the track becomes more random, but the movement track of the locking device is always within a swinging range, the range is similar to a sector, the guide groove is used for restricting the sector range and further restricting the swinging range of the locking device, but when the swinging of the locking device is overlarge, the locking device is resisted by the guide surface to prevent the locking device from leaving the swinging range appointed by the guide groove, the swinging range of the locking device is smaller and smaller under the influence of the V-shaped guide groove along with the downward movement of the locking device, and finally the locking device can only enter the locking groove at the end point of the guide groove, through the scheme, the movement track of the locking device is not singly locked, namely the locking device does not move along the single movement track, the mechanical extension unit can swing relative to the base, but the movement track of the locking device is subjected to range locking, or to the motion terminal point of locking device lock, can guarantee that the locking device can both block into the locking groove safely unimpededly at every turn, avoided locking device and other member card dead trouble emergence.

Preferably, the upper ends of the first swinging rod and the second swinging rod are rotatably connected to the base, the lower ends of the first swinging rod and the second swinging rod are rotatably connected to the mechanical extension unit, the front part of the mechanical extension unit are rotatably connected to the first swinging rod, and the rear part of mechanical extension unit are rotatably connected to the second swinging rod; when the actuator is stopped and the mechanical extension unit swings relative to the base, the first swinging rod and the second swinging rod rotate in synchronization. The mechanical extension unit is connected to the lower end parts of the two swinging rods, so that the height of the whole mechanical extension device is reduced, the height of the seat surface is reduced, and the comfort is improved.

Preferably, the base comprises a supporting seat and a substrate, the substrate is fixedly connected to the supporting seat, the substrate is provided with a first connecting portion and a second connecting portion which is located at the front end and the rear end, the first connecting portion is protruding towards the front upper side, the second connecting portion is protruding towards the back upper side, the first swinging rod is connected to the upper end portion of the first connecting portion in a rotating mode, the second swinging rod is connected to the upper end portion of the second connecting portion in a rotating mode, and the first swinging rod and the second swinging rod droop to the side of the substrate. The first connecting portion and the second connecting portion are protruded upwards, so that the first swinging rod and the second swinging rod are guaranteed to have enough height to rotate relative to the base, the mechanical extension unit can smoothly swing relative to the base, the first swinging rod and the second swinging rod are drooped at the side of the base plate, the connecting height of the mechanical extension unit is reduced, the height of the seat surface cannot be greatly influenced by the upward protruded first connecting portion and the second connecting portion, and the mechanical extension device can still keep lower height of the seat surface, so that the sitting comfort is improved.

Preferably, the guide groove and the locking groove are formed in the substrate, and are positioned between the first connecting portion and the second connecting portion and in the middle of the substrate; the locking device is located the upper end of second connecting rod; and when the position of sitting switched to the position of lying, the second connecting rod rotated forward, and the locking device Enter the guide groove.

Preferably, the second connecting rod is rotatably connected to a seat connecting rod and a backrest connecting rod, one end of the backrest connecting rod is rotatably connected to the second connecting rod, the other end of the backrest connecting rod is rotatably connected to the lower end part of the backrest connector, the lower end of the seat connecting rod is rotatably connected to the second connecting rod, and the upper end of the seat connecting rod is fixedly connected to the seat connector; when the second connecting rod rotates forwards, the backrest connecting rod drives the backrest connector to incline backwards relative to the seat connector, and the seat connecting rod drives the seat connector to descend. when the second connecting rod is driven by the linkage rod, the backrest connecting rod and the seat connecting rod are synchronously driven, so that the backrest connector and the seat connector move together, the overall movement of the mechanical extension unit is realized, the number of rod is less, and the structure of the mechanical extension unit is simpler.

Preferably, the upper end of the first connecting rod is fixedly connected to the front part of the seat connector, the seat part link is fixedly connected to the rear part of the seat connector, and the first connecting rod and the seat part link are configured to keep the height of the front part of the seat connector unchanged when the sitting posture state is switched to the lying posture state, so that the seat part link drives the rear part of the seat connector to sink. Realize low level high foot through this scheme, promote to sit and feel.

Preferably, the actuator is connected to the mechanical extension unit through a first drive tube and a second drive tube, the first drive tube is connected to the leg rest link assembly, and the second drive tube is connected to the seat connecting rod. The two mechanical extension units are moved synchronously by a single actuator.

Preferably, the leg rest connecting rod assembly comprises a first leg connecting rod, a second leg connecting rod, a third leg connecting rod and a fourth leg connecting rod, the first leg connecting rod are rotationally connected to the seat connector, the lower end of the first leg connecting rod is rotationally connected to one end of the third leg connecting rod, the other end of the third leg connecting rod is rotationally connected to the footrest, the lower end of the second leg connecting rod is rotationally connected to one end of the fourth leg connecting rod, the other end of the fourth leg connecting rod is rotationally connected to the footrest, and the lower part of the second leg connecting rod is also rotationally connected to the third leg connecting rod; the middle part of the first leg connecting rod is rotationally connected to the linkage rod; the first driving pipe is fixedly connected to the second leg connecting rod.

Preferably, the base comprises a rotating base and a base plate, the rotating base comprises a rotating seat and a fixed seat, the rotating seat is rotatably arranged on the fixed seat, the base plate is fixedly arranged on the rotating seat, the first swinging rod and the second swinging rod are rotatably connected onto the base plate, and the mechanical extension unit is rotatably connected to the first swinging rod and the second swinging rod; there are several rolling balls between the rotating seat and the fixed seat, and the surfaces opposite the rotating seat and the fixed seat are all equipped with rolling grooves, The rolling balls are located in the rolling grooves, and the rotating seat rotates relative to the fixed seat through the rolling balls, and the user can sit towards different directions.

The design starting point, concept and beneficial effect of the invention adopting the technical scheme are as follows:

the mechanical extension units are not directly connected to the base in a rotating mode, but are arranged on the base in a swinging mode through the first swinging rod and the second swinging rod, and can swing back and forth relative to the base to improve the sitting feeling; because the actuator is arranged between the two mechanical extension units, under the condition that the actuator is locked, the rods of the two mechanical extension units cannot move, so that the mechanical extension units can integrally swing on the base under the condition that the movement of the mechanical extension units is not interfered, and the relative movement between the rods of the mechanical extension units cannot occur; one side of the guide groove is open, and even when the mechanical extension unit swings relative to the base, the locking device can still enter the locking groove in an unobstructed and guided mode; the actuator is not attached to the base but to the seat connector and leg rest connecting rod assembly, and is one of the bases for achieving the swinging motion of the mechanical extension unit.

Firstly, under the condition that the mechanical extension unit does not swing, the locking device moves along a preset motion track under the preset configuration of each rod piece of the mechanical extension unit and can enter the locking groove without hindrance, and the locking device does not need the guide groove to play a role in guiding, which is the most basic requirement; when the mechanical extension unit swings, the locking device swings along with the mechanical extension unit and does not move along a set movement track any more, the track becomes more random, but the movement track of the locking device is always within a swinging range, the range is similar to a sector, the guide groove is used for restricting the sector range and further restricting the swinging range of the locking device, but when the swinging of the locking device is overlarge, the locking device is resisted by the guide surface to prevent the locking device from leaving the swinging range appointed by the guide groove, the swinging range of the locking device is smaller and smaller under the influence of the V-shaped guide groove along with the downward movement of the locking device, and finally the locking device can only enter the locking groove at the end point of the guide groove, through the scheme, the movement track of the locking device is not singly locked, namely the locking device does not move along the single movement track, the mechanical extension unit can swing relative to the base, but the movement track of the locking device is subjected to range locking, or to the motion terminal point of locking device lock, can guarantee that the locking device can both block into the locking groove safely unimpededly at every turn, avoided locking device and other member card dead trouble emergence.

Figure 1:
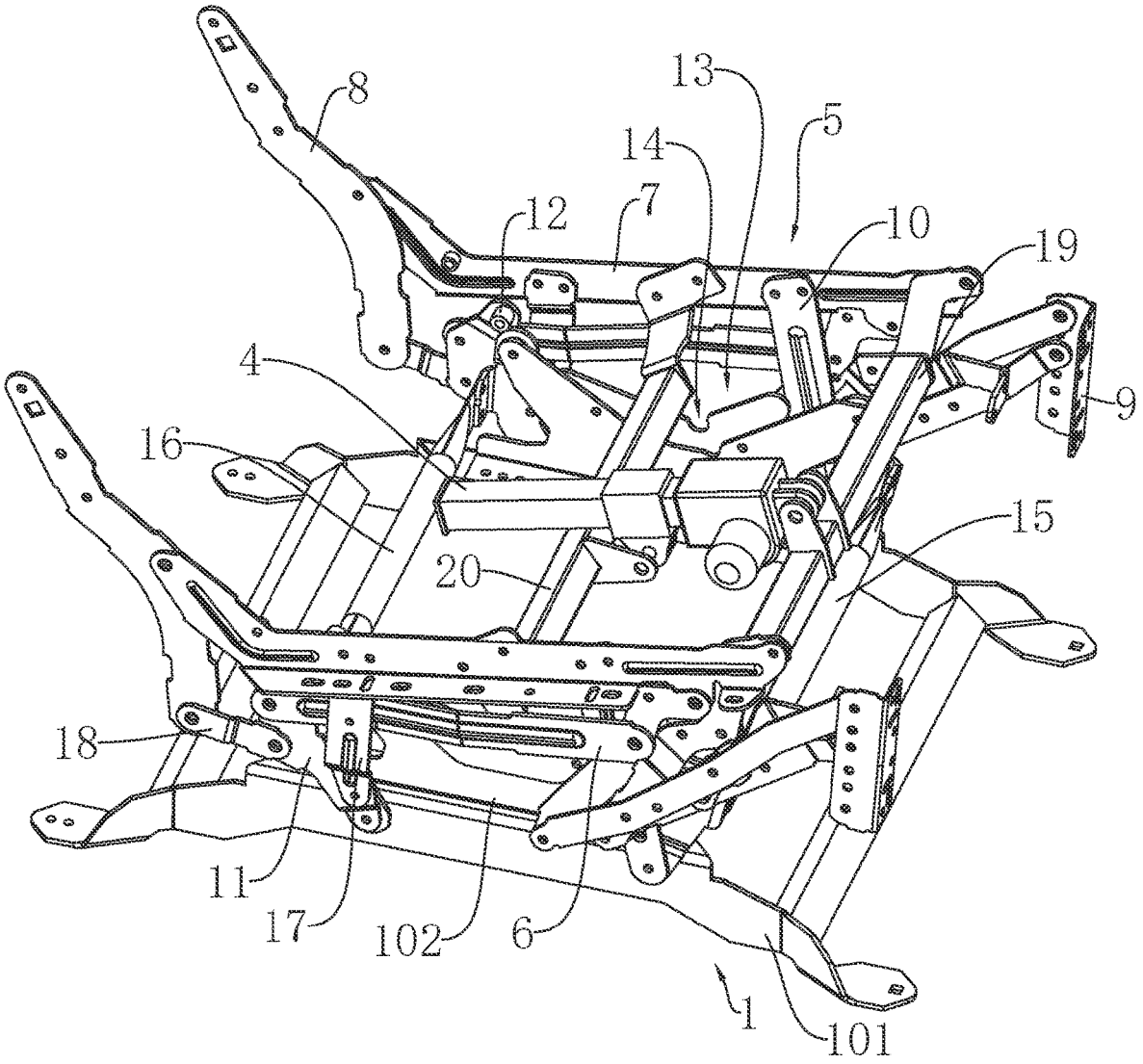
FIG. 1 is a schematic view of a sitting posture state three-dimensional structure in embodiment 1 of the present invention.

The reference signs are: a base 1; a support base 101; a substrate 102; a first connection portion 1021; the second connecting portion 1022; a first swinging rod 2; a second swinging rod 3; an actuator 4; a mechanical extension unit 5; a linkage rod 6; a seat connector 7; a backrest connector 8; a footrest 9; a first connecting rod 10; a second connecting rod 11; a lock member 12; a guide groove 13; a guide surface 131; a locking groove 14; a first fixing lever 15; a second fixing lever 16; a seat connecting rod 17; a backrest connecting rod 18; a first drive pipe 19; a second drive tube 20; a first leg connecting rod 21; a second leg connecting rod 22; a third leg connecting rod 23; a four leg connecting rod 24; a rotating seat 25; a fixed seat 26; a ball 27; a circular ring frame 28.

DETAILED DESCRIPTION OF THE EMBODIMENTS

Figure 2:
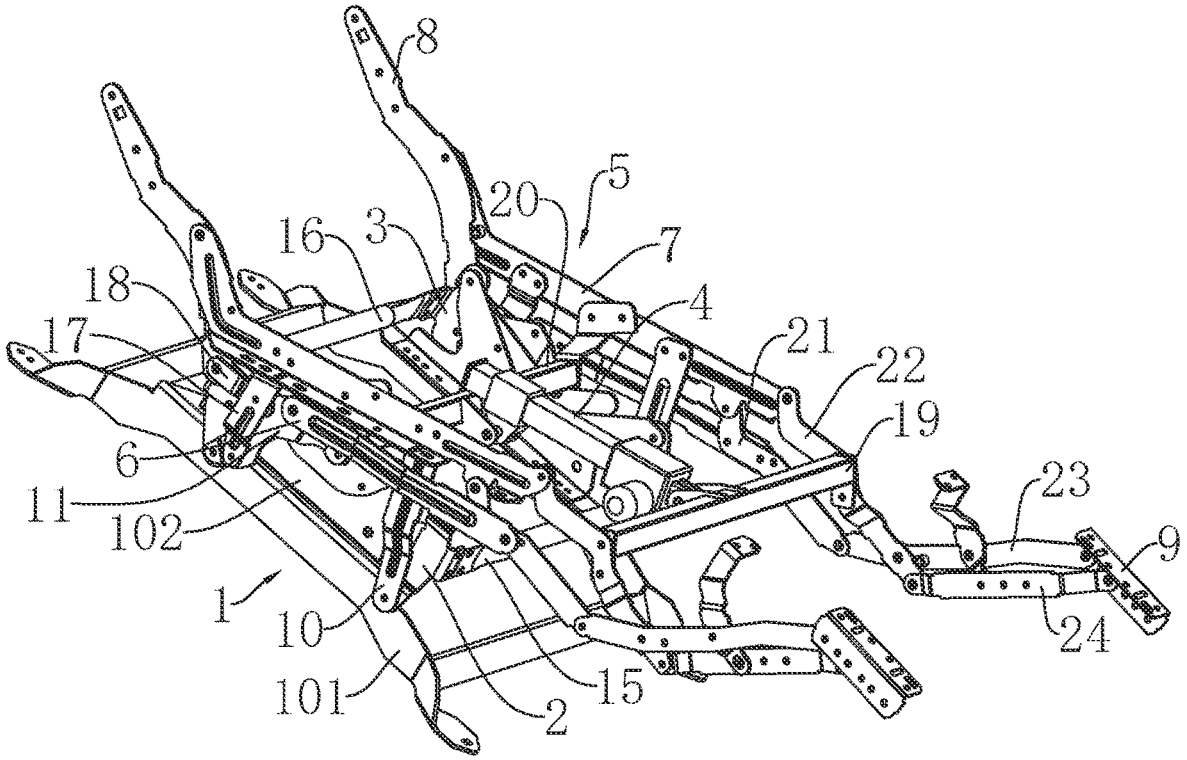
FIG. 2 is a schematic view of a lying posture state three-dimensional structure in embodiment 1 of the present invention.

The specific implementation mode of the invention is as follows:

Example 1 as shown in FIG. 1 and FIG. 2, the present invention provides a mechanical extension device of a swing seat, including a base 1, a first swinging rod 2, a second swinging rod 3, an actuator 4, and two mechanical extension units 5 symmetrically arranged left and right, where the first swinging rod 2 and the second swinging rod 3 are rotationally connected to the base 1 in tandem and at intervals, the two mechanical extension units 5 are rotationally connected to the first swinging rod 2 and the second swinging rod 3, and the first swinging rod 2 and the second swinging rod 3 are configured to enable the mechanical extension units 5 to swing on the base 1; the actuator 4 is arranged between the two mechanical extension units 5 and drives the mechanical extension units 5 to move; the mechanical extension unit 5 comprises a linkage rod 6, a seat connector 7, a backrest connector 8, a footrest 9, a leg rest connecting rod assembly, a first connecting rod 10 and a second connecting rod 11, wherein the seat connector 7 is used for installing a seat part, the backrest connector 8 is used for installing a backrest, the footrest 9 is used for installing a leg rest, the footrest 9 is installed on the leg rest connecting rod assembly, the leg rest connecting rod assembly extends under the action of an actuator 4 and controls the footrest 9 to fold or extend, the leg rest connecting rod assembly is arranged at the front end part of the seat connector 7, and the backrest connector 8 is arranged at the rear end part of the seat connector 7; the first connecting rod 10 is rotationally connected to the first swinging rod 2, and the second connecting rod 11 is rotationally connected to the second swinging rod 3; the actuator 4 is respectively connected to the seat connector 7 and the leg rest connecting rod assembly in a rotating way and drives the two to move relatively; two ends of the linkage rod 6 are respectively in rotary connection with the leg rest connecting rod assembly and the second connecting rod 11, and when the actuator 4 drives the leg rest connecting rod assembly to move, the linkage rod 6 drives the second connecting rod 11 to move; a locking device 12 is arranged on the second connecting rod 11, a guide groove 13 with an open side is formed in the base 1, and a locking groove 14 is formed in the path end point of the guide groove 13; the chair also has a sitting posture state for a human body to sit and a lying posture state for the human body to lie, the leg rest connecting rod assembly is furled in front of the seat connector 7 in the sitting posture state, and the backrest connector 8 is approximately vertical; when the sitting posture state is switched to the lying posture state, the leg rest connecting rod assembly is driven by the actuator 4 to extend and the linkage rod 6 drives the second connecting rod 11 to move, the second connecting rod 11 drives the backrest connector 8 to tilt backwards, meanwhile, the locking device 12 enters the guide groove 13 from the opened side of the guide groove 13 and is guided to the locking groove 14 by the guide groove 13, the mechanical extension unit 5 and the base 1 swing relatively, and the lying posture state is switched.

The mechanical extension units 5 are not directly connected to the base 1 in a rotating mode, but the two mechanical extension units 5 are arranged on the base 1 in a swinging mode through the first swinging rod 2 and the second swinging rod 3, and can swing back and forth relative to the base 1 to improve the sitting feeling; because the actuator 4 is arranged between the two mechanical extension units 5, under the condition that the actuator 4 is locked, the rods of the two mechanical extension units 5 cannot move, so that the mechanical extension units 5 can integrally swing on the base 1 under the condition that the movement is not interfered, and the relative movement between the rods of the mechanical extension units 5 cannot occur; one side of the guide groove 13 is open, so that even when the mechanical extension unit 5 swings relative to the base 1, the locking device 12 can still enter the locking groove 14 in an unobstructed and guided manner, the condition of blocking or damaging the rod piece can not occur, the occurrence of faults is avoided, and the maintenance cost is saved; the actuator 4 is not attached to the base 1 but to the seat connector 7 and the footrest link assembly, improving the driving efficiency.

Figure 8:
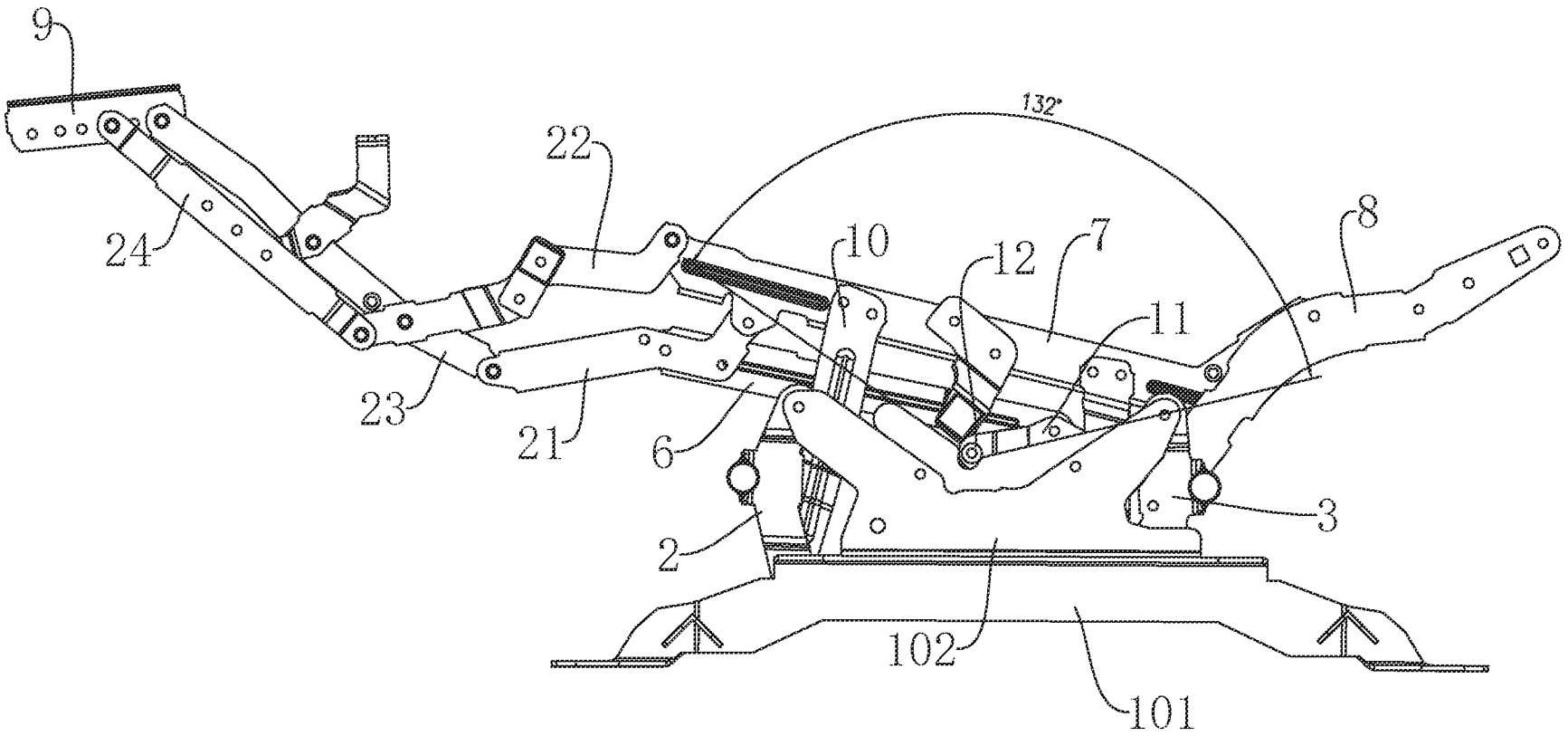
FIG. 8 is a second side view of embodiment 1 of the present invention in a lying position.
Figure 9:
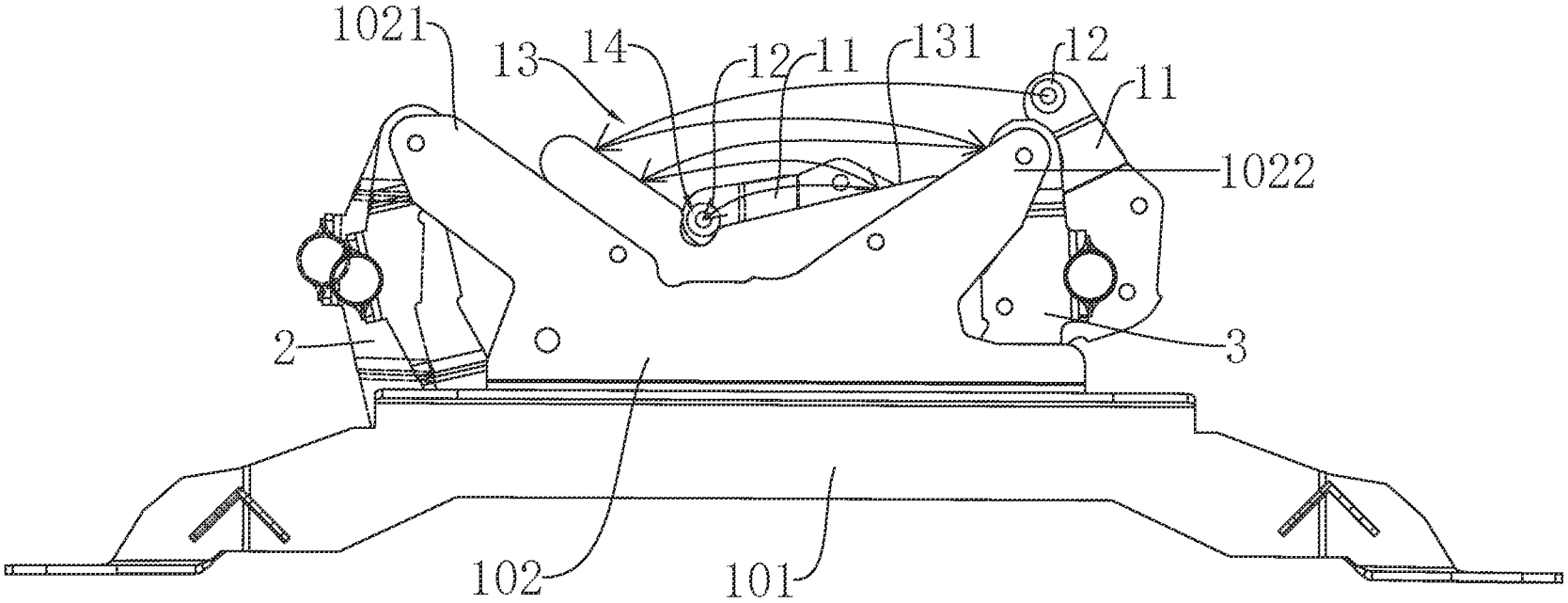
FIG. 9 is a schematic view of the fan-shaped motion of the latch according to embodiment 1 when the mechanical extending unit swings.

As shown in FIG. 8, the guide groove 13 is a V-shaped slot opened upward, the opening angle range is 120°-150°, and the opening angle of the guide groove 13 is 132° in this embodiment; the walls of the guide groove 13 are guide surfaces 131, the guide surfaces 131 are configured such that the mechanical extension unit 5 swings relative to the base 1 while being moved by the actuator 4, and the locking member 12 can still intermittently contact the guide surfaces 131 and approach the locking slot 14 without hindrance; the opening of the guide groove 13 is an obtuse angle with a large angle, so that the guide groove has enough avoidance space for the locking device 12 to move in the guide groove 13 along with the swinging of the mechanical extension unit 5, and the movement of the locking device 12 is not hindered; specifically, as shown in FIG. 9, the locking member 12 is not always in contact with the guide groove 13, and first, in the case that the mechanical extension unit 5 does not swing, the locking member 12 moves along a predetermined movement track under the preset configuration of each rod of the mechanical extension unit 5, and can enter the locking groove 14 without hindrance, and the guide groove 13 is not needed to play a guiding role at all, which is the most basic requirement; when the mechanical extension unit 5 swings, the locking member 12 swings along with the mechanical extension unit, and does not move along the predetermined movement track any more, the movement track becomes more random, but the movement track of the locking member 12 always stays within a swing range, which is similar to a sector, the guide groove 13 functions to restrict the sector range, and further restricts the swing range of the locking member 12, but when the swing of the locking member 12 is too large, the locking member 12 is resisted by the guide surface 131, so as to prevent the locking member 12 from leaving the swing range which the guide groove 13 stipulates, as the locking member 12 moves downward, the swing range is affected by the V-shaped guide groove 13 to become smaller and smaller, and finally only enters the locking groove 14 at the end point of the guide groove 13, through the above scheme, the movement track of the locking member 12 is not singly locked, that the locking member 12 does not move along a single movement track, so that the mechanical extension unit 5 can swing relative to the base 1, however, the range of the movement track of the locking member 12 is locked, or the movement end point of the locking member 12 is locked, so that the locking member 12 can be safely clamped into the locking groove 14 without hindrance each time, and the occurrence of the fault that the locking member 12 is locked with other rod members is avoided.

Figure 3:
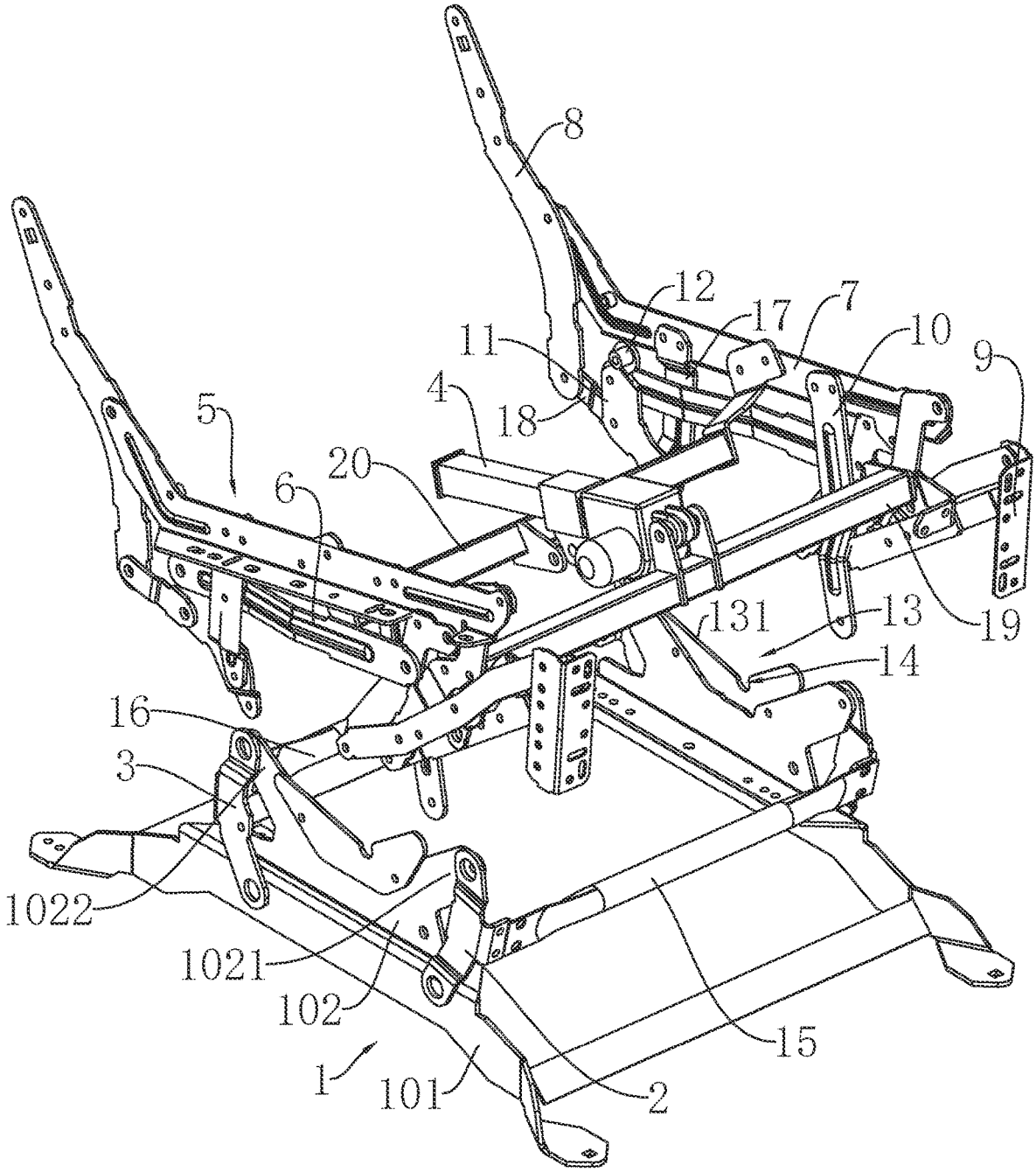
FIG. 3 is an exploded view of the sitting posture state of the present invention in accordance with embodiment 1.
Figure 4:
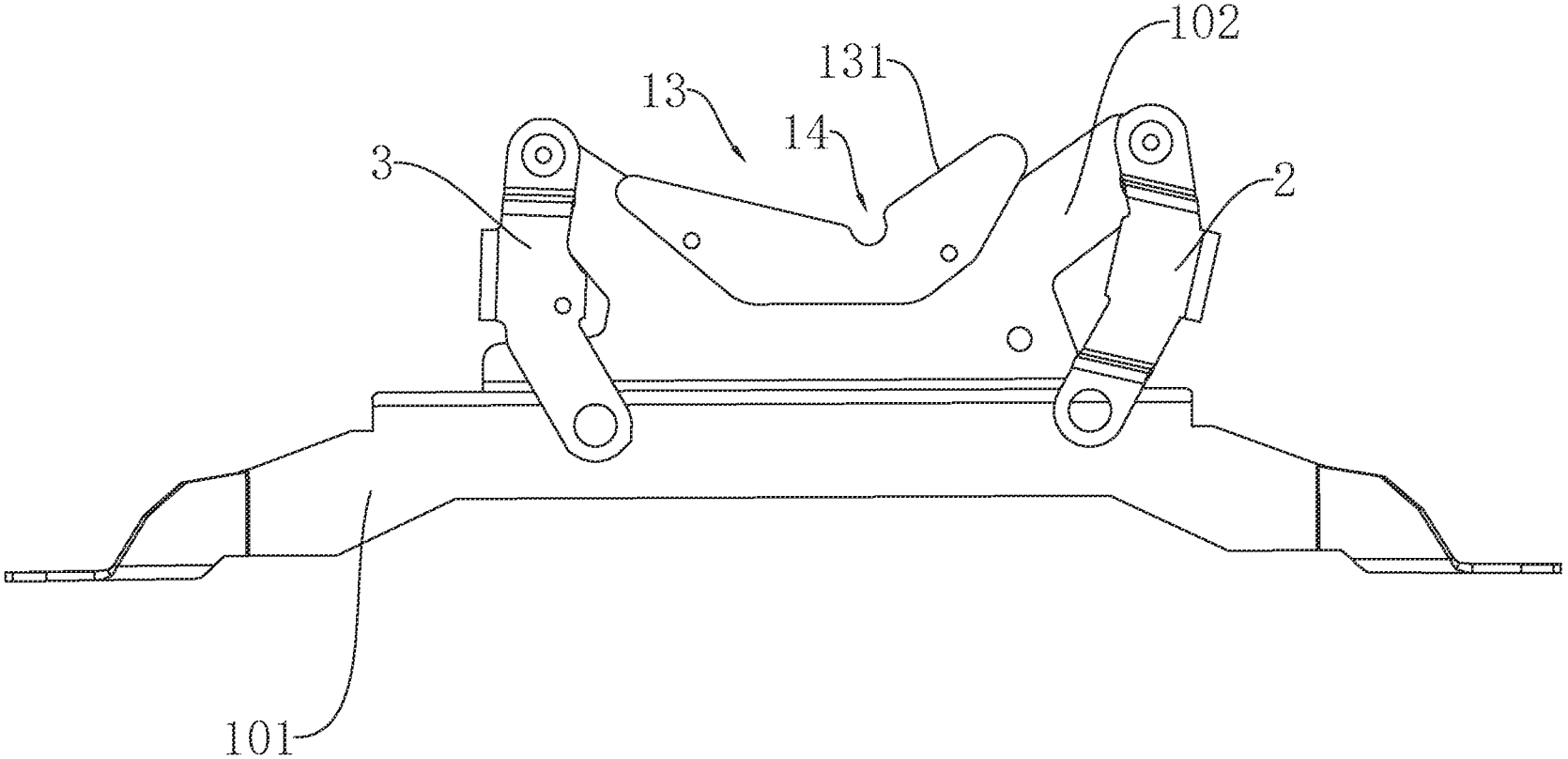
FIG. 4 is a side view of the first and second swinging rods attached to the base in embodiment 1 of the present invention.
Figure 5:
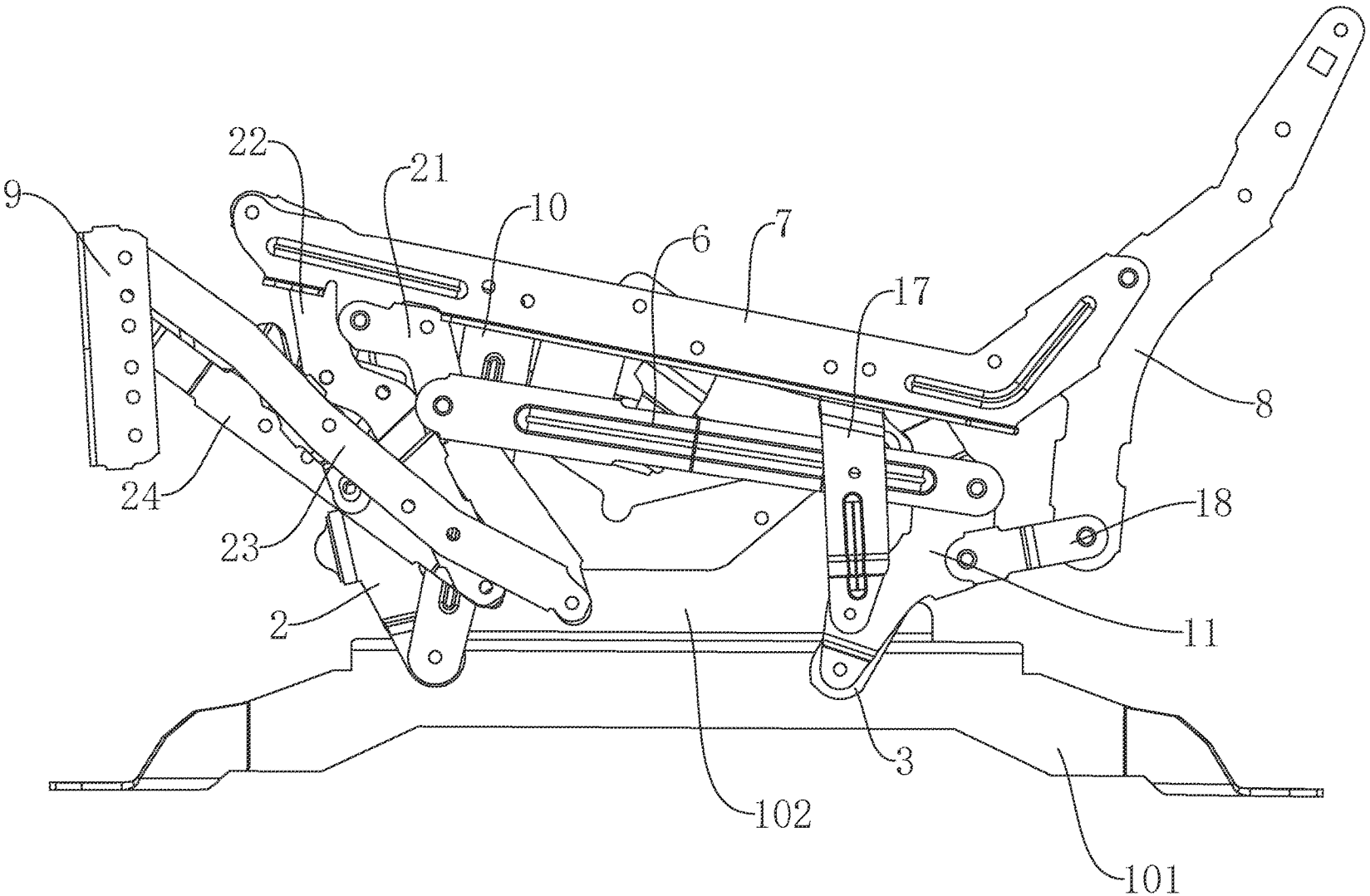
FIG. 5 is a first side view of the sitting position of the chair according to embodiment 1 of the present invention.
Figure 6:
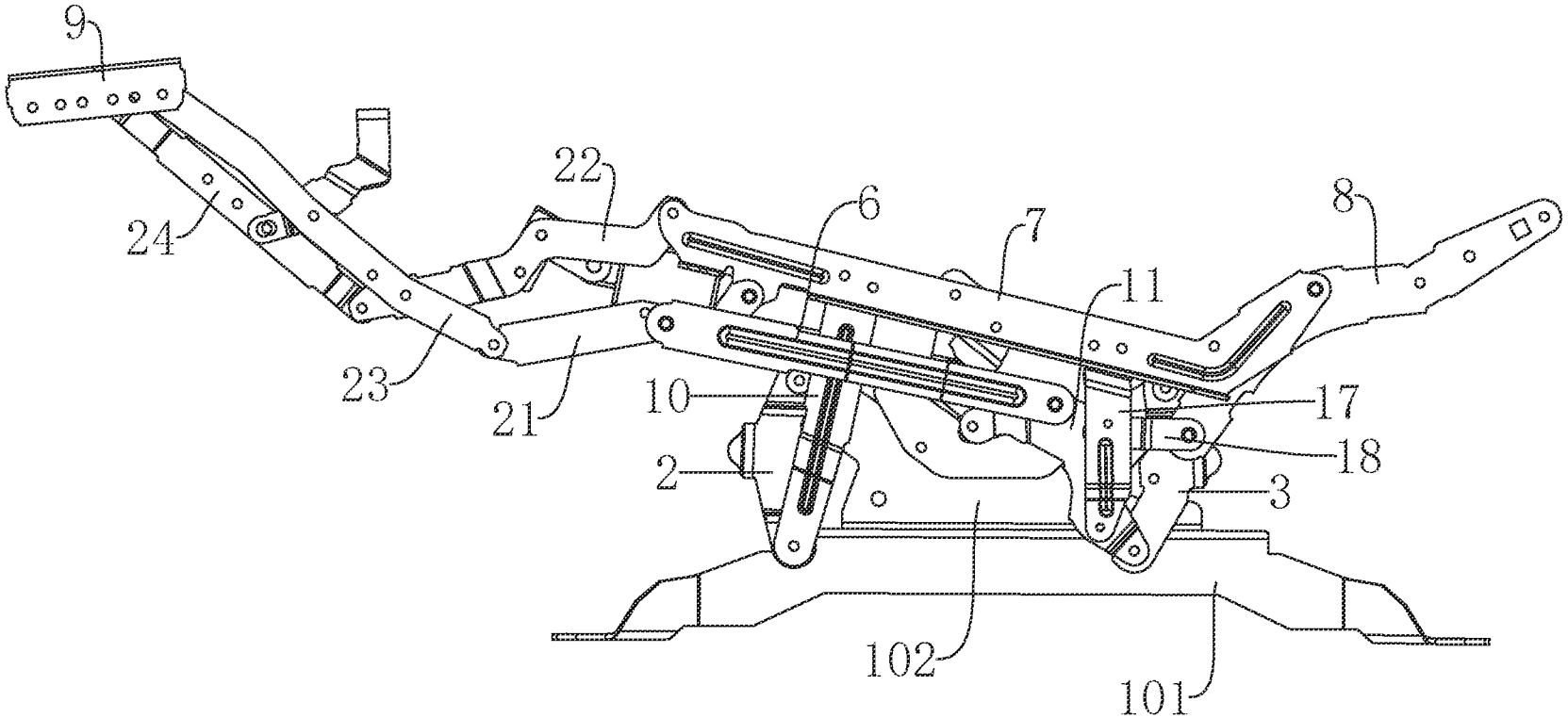
FIG. 6 is a first side view of embodiment 1 of the present invention in a lying position.
Figure 7:
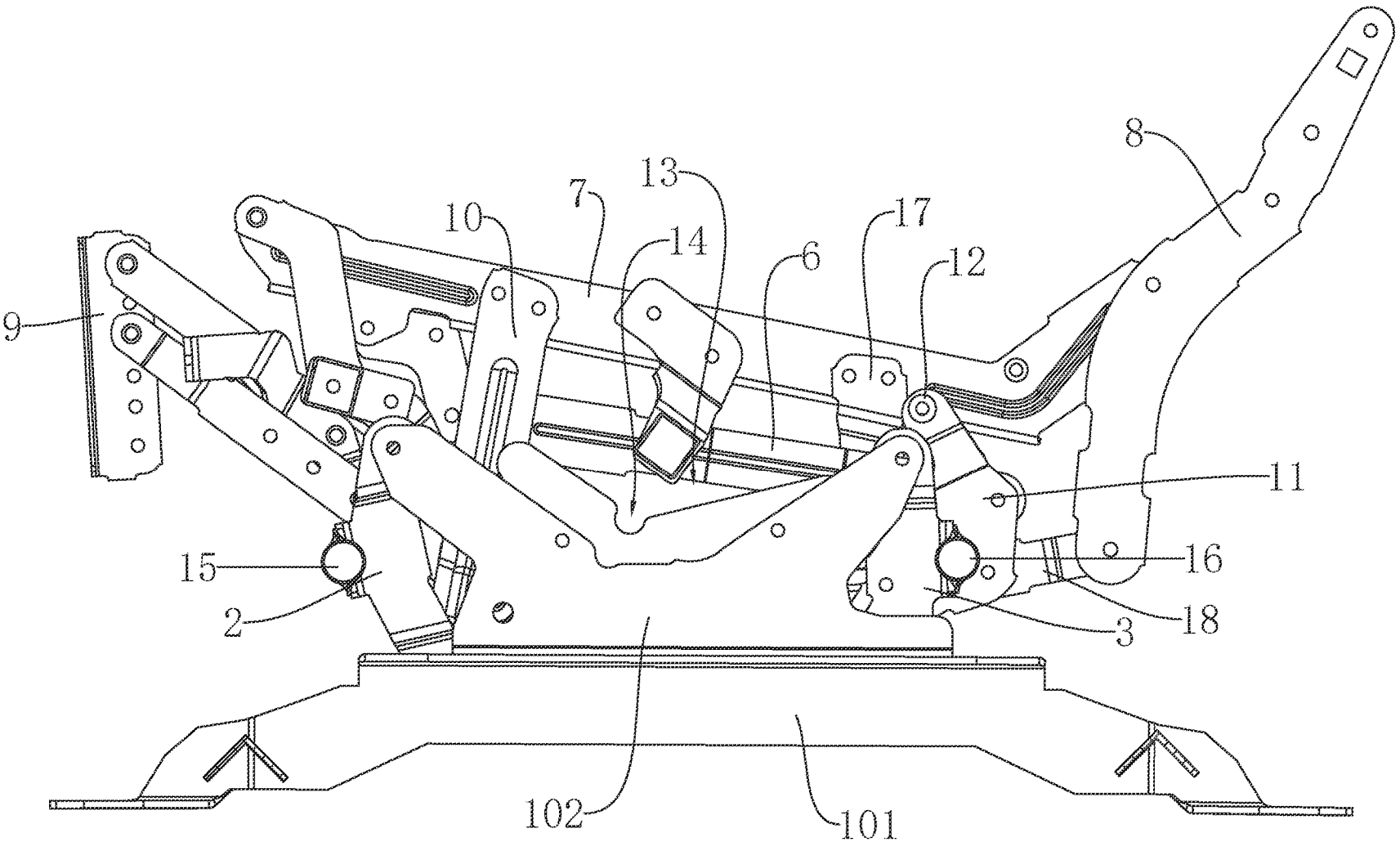
FIG. 7 is a side view of the second sitting position of the chair of embodiment 1.

As shown in FIGS. 3 and 4, the upper ends of the first swinging rod 2 and the second swinging rod 3 are rotatably connected to the base 1, the lower ends of the first swinging rod and the second swinging rod are rotatably connected to the mechanical extension units 5, the front portions of the two mechanical extension units 5 are rotatably connected to the first swinging rod 2, and the rear portions of the two mechanical extension units 5 are rotatably connected to the second swinging rod 3; when the actuator 4 is stopped and the mechanical extension unit 5 swings with respect to the base 1, the first swinging rod 2 and the second swinging rod 3 rotate in synchronization; the mechanical extension unit 5 is connected to the lower end parts of the two swinging rods, so that the height of the whole mechanical extension device is reduced, the height of the seat surface is reduced, and the comfort is improved.

The base 1 comprises a supporting seat 101 and a substrate 102, the substrate 102 is fixedly connected to the supporting seat 101, the substrate 102 has a first connecting part 1021 and a second connecting part 1022 which are located at the front end and the rear end, the first connecting part 1021 is convex towards the front and the upper direction, the second connecting part 1022 is convex towards the rear and the upper direction, a first swinging rod 2 is rotatably connected to the upper end part of the first connecting part 1021, a second swinging rod 3 is rotatably connected to the upper end part of the second connecting part 1022, and the first swinging rod 2 and the second swinging rod 3 droop to the side of the substrate 102; the guide groove 13 and the locking groove 14 are formed in the substrate 102, and the guide groove 13 and the locking groove 14 are located between the first connecting portion 1021 and the second connecting portion 1022 and in the middle of the substrate 102; the locking member 12 is located at the upper end of the second connecting rod 11, when the sitting posture state is switched to the lying posture state, the second connecting rod 11 rotates forward, and the locking member 12 passes over the second connecting part 1022 and enters the guide groove 13; the first connecting portion 1021 and the second connecting portion 1022 protrude upward, so that the first swinging rod 2 and the second swinging rod 3 are ensured to have sufficient heights to rotate relative to the base 1, the mechanical extension unit 5 can swing smoothly relative to the base 1, the first swinging rod 2 and the second swinging rod 3 hang down at the side of the substrate 102, and the connecting height of the mechanical extension unit 5 is reduced, so that the height of the seat surface is not greatly affected by the first connecting portion 1021 and the second connecting portion 1022 protruding upward, and the mechanical extension device can still keep a lower height of the seat surface, so as to improve the sitting comfort.

Supporting seat 101 is square frame, the left and right sides of supporting seat 101 all is equipped with vertical base plate 102, all rotate on every side base plate 102 and be connected to first swinging arms 2 and second swinging arms 3, connect through the horizontal first dead lever 15 that sets up along the left and right directions between the first swinging arms 2 of both sides, connect through the horizontal second dead lever 16 that sets up along the left and right directions between the second swinging arms 3 of both sides, the swing of both sides mechanical extension unit 5 is synchronous through first dead lever 15 and second dead lever 16.

As shown in FIGS. 5-8, the second connecting rod 11 is further rotatably connected to a seat connecting rod 17 and a backrest connecting rod 18, one end of the backrest connecting rod 18 is rotatably connected to the second connecting rod 11, the other end of the backrest connecting rod 18 is rotatably connected to the lower end of the backrest connector 8, the lower end of the seat connecting rod 17 is rotatably connected to the second connecting rod 11, and the upper end of the seat connecting rod 17 is fixedly connected to the seat connector 7; when the second connecting rod 11 rotates forwards, the backrest connecting rod 18 drives the backrest connector 8 to incline backwards relative to the seat connector 7, and the seat connecting rod 17 drives the seat connector 7 to descend; when the second connecting rod 11 is driven by the linkage rod 6, the backrest connecting rod 18 and the seat connecting rod 17 are synchronously driven, so that the backrest connector 8 and the seat connector 7 move together, and the integral movement of the mechanical extension unit 5 is realized.

The upper end of the first connecting rod 10 is fixedly connected to the front part of the seat connector 7, the seat connecting rod 17 is fixedly connected to the rear part of the seat connector 7, and when the first connecting rod 10 and the seat connecting rod 17 are configured to be switched from a sitting posture state to a lying posture state, the first connecting rod 10 keeps the height of the front part of the seat connector 7 unchanged, and the seat connecting rod 17 drives the rear part of the seat connector 7 to sink. Realize low level high foot through this scheme, promote to sit and feel.

The actuator 4 is connected to the mechanical extension unit 5 through a first driving pipe 19 and a second driving pipe 20, the first driving pipe 19 is connected to the leg rest connecting rod assembly, and the second driving pipe 20 is connected to the seat connecting rod 17; the two mechanical extension units 5 are moved synchronously by a single actuator 4; the leg rest connecting rod assembly comprises a first leg connecting rod 21, a second leg rest connecting rod 22, a third leg rest connecting rod 23 and a fourth leg rest connecting rod 24, the upper end part of the rotation of the first leg connecting rod 21 and the second leg rest connecting rod 22 is rotationally connected to the seat connector 7, the connecting point of the first leg connecting rod 21 and the seat connector 7 is positioned behind the connecting point of the second leg rest connecting rod 22 and the seat connector 7, the lower end of the first leg connecting rod 21 is rotationally connected to one end of the third leg rest connecting rod 23, the other end of the third leg rest connecting rod 23 is rotationally connected to the footrest 9, the lower end of the second footrest 9 is rotationally connected to one end of the fourth leg rest connecting rod 24, the other end of the fourth leg rest connecting rod 24 is rotationally connected to the footrest 9, and the lower part of the second leg rest connecting rod 22 is also rotationally connected to the third leg rest connecting rod 23; the middle part of the first leg connecting rod 21 is rotationally connected to the linkage rod 6; the first drive tube 19 is fixedly connected to a second leg connecting rod 22 of the leg rest link assembly.

The actuator 4 is an electric push rod, when the actuator 4 drives the mechanical extension device to switch from a sitting posture state to a lying posture state, the second leg rest connecting rod 22 rotates forwards to drive the whole leg rest connecting rod assembly to stretch forwards, the first leg connecting rod 21 drives the linkage rod 6 to move forwards, the linkage rod 6 drives the second connecting rod 11 to rotate forwards, the second connecting rod 11 drives the seat connecting rod 17 and the backrest connecting rod 18 to move along with the linkage rod, so that the backrest connector 8 tilts backwards relative to the seat connector 7, and the rear part of the seat connector 7 sinks; at the same time, the locking device 12 is clamped into the locking groove 14; the first and second pivoting levers 2, 3 only suspend the pivoting function of the mechanical extension unit 5 after the locking element 12 has snapped into the locking groove 14.

Figure 10:
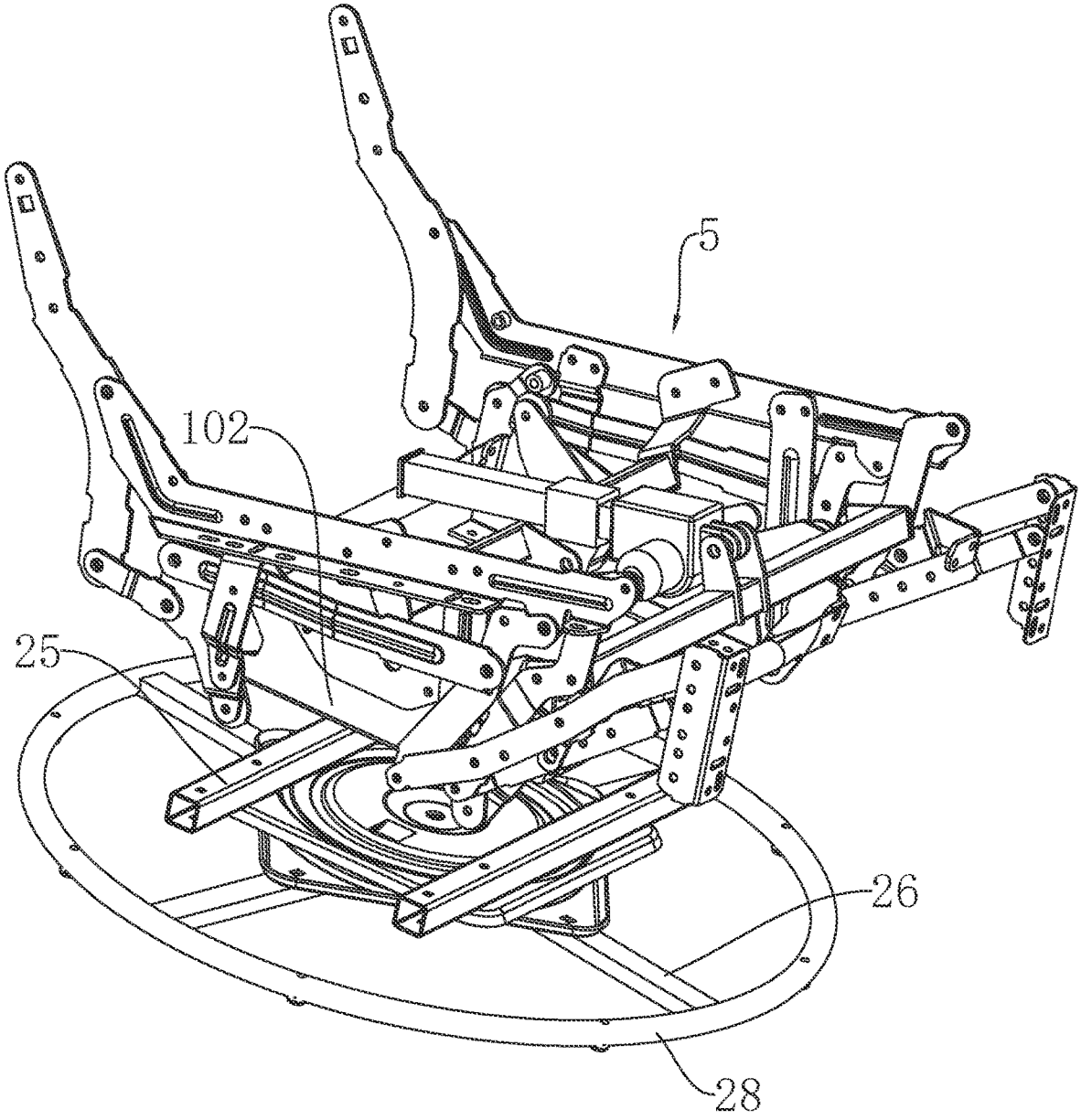
FIG. 10 is a schematic perspective view illustrating an installation of a substrate and a rotating base according to embodiment 2 of the present invention.
Figure 11:
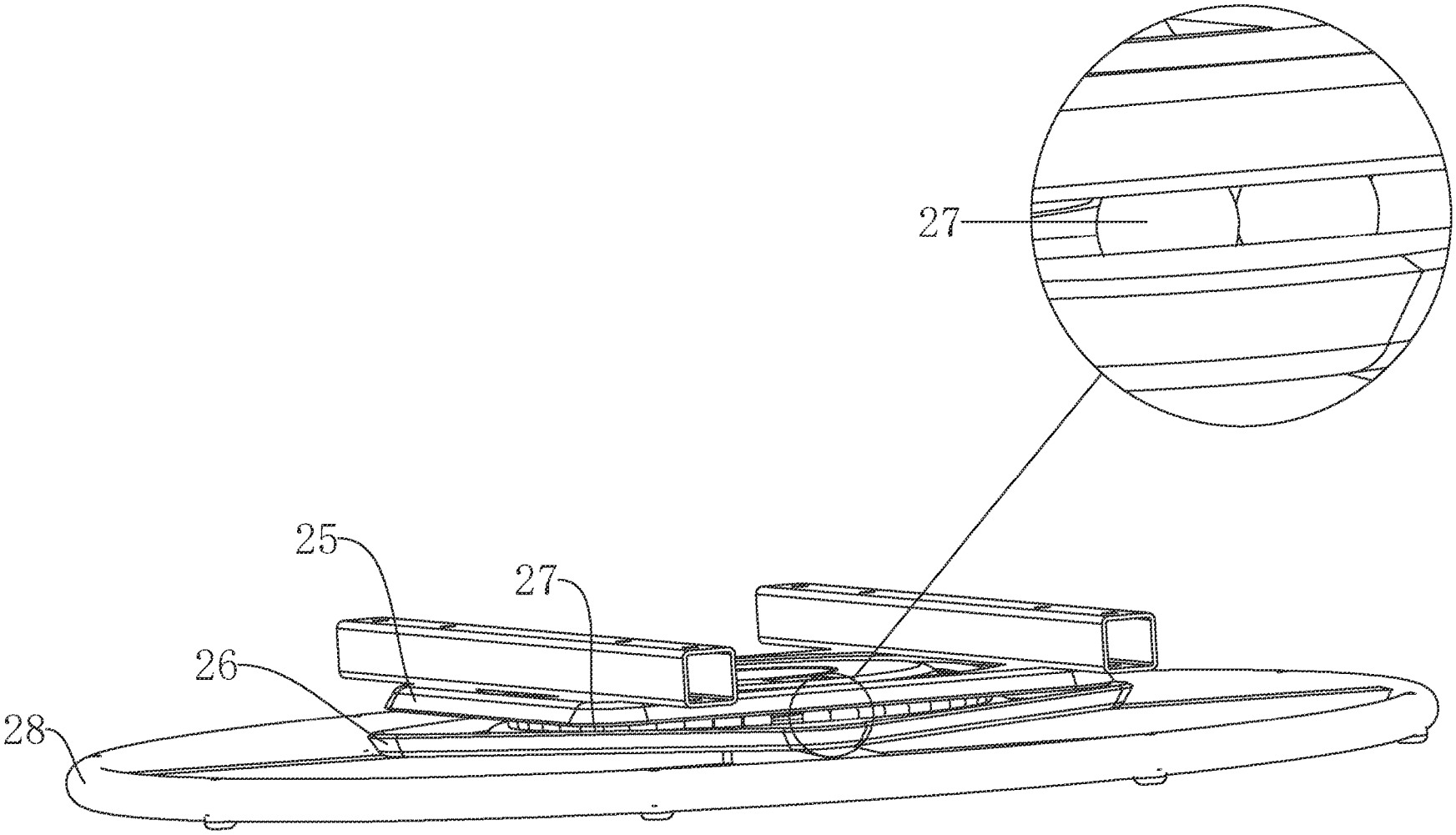
FIG. 11 is a schematic perspective view of a rotating base in embodiment 2 of the present invention.

Example 2: the present embodiment is different from embodiment 1 only in the difference of the base 1. Specifically, as shown in FIG. 10 and FIG. 11, the base 1 includes a rotating base and a base plate 102, the rotating base includes a rotating seat 25 and a fixed seat 26, a plurality of balls 27 are disposed between the rotating seat 25 and the fixed seat 26, annular ball grooves are disposed on opposite surfaces of the rotating seat 25 and the fixed seat 26, the balls 27 are disposed in the two ball grooves, and the rotating seat 25 is rotatably disposed on the fixed seat 26 through the balls 27; the substrate 102 is fixedly mounted on the rotary base 25, and the substrate 102 in the present embodiment is the same as the substrate 102 in embodiment 1; first swinging arms 2 and second swinging arms 3 rotate to be connected on base plate 102, and mechanical extension unit 5 rotates with first swinging arms 2, second swinging arms 3 to be connected, and when rotation seat 25 rotated for fixing base 26, rotation seat 25 drove mechanical extension unit 5 and together rotated to realize the rotation of seat, back and the bracket of thing to sit on, the orientation that the user sat also takes place to rotate, and the user can sit towards different directions.

The fixed seat 26 comprises a circular frame 28, the rotating seat 25 is located at the center of the circular frame 28, when the rotating seat 25 drives the mechanical extension unit 5 to rotate, the direction of the stress on the fixed seat 26 will be changed due to the change of the orientation of the human body, the circular frame 28 can effectively adapt to the change, and the circular frame 28 can keep the overall stability of the mechanical extension device and prevent the mechanical extension device from tipping regardless of the direction to which the rotating seat 25 rotates.

What is claimed is:

1. A mechanical extension device for a rocking chair, comprising: a base, a first swinging rod, a second swinging rod, an actuator, and two mechanical extension units arranged in a bilateral symmetry, wherein the first swinging rod and the second swinging rod are connected to the base, the two mechanical extension units are connected to the first swinging rod and the second swinging rod in a rotating mode, and the first swinging rod and the second swinging rod are configured to swing the two mechanical extension units on the base; the actuator is arranged between the two mechanical extension units and drives the two mechanical extension units to act; each of the two mechanical extension units comprises a linkage rod, a seat connector, a backrest connector, a footrest, a leg rest connecting rod assembly, a first connecting rod, and a second connecting rod, the footrest is installed on the leg rest connecting rod assembly, the leg rest connecting rod assembly is configured to extend under an action of the actuator and control the footrest to fold or extend, the leg rest connecting rod assembly is arranged at a front end part of the seat connector, and the backrest connector is arranged at a rear end part of the seat connector, the first connecting rod is rotationally connected to the first swinging rod, and the second connecting rod is rotationally connected to the second swinging rod, two ends of the linkage rod are respectively in a rotary connection to the leg rest connecting rod assembly and the second connecting rod; the actuator is respectively connected to the seat connector and the leg rest connecting rod assembly in a rotating way and drives the seat connector and the leg rest connecting rod assembly to move relatively; a locking device is arranged on the second connecting rod, a guide groove with an open side is formed in the base, and a locking groove is formed in a path end point of the guide groove; the rocking chair is provided with a sitting posture state for a human body to sit and a lying posture state for the human body to lie, and the leg rest connecting rod assembly is folded in front of the seat connector in the sitting posture state; when the sitting posture state is switched to the lying posture state, the leg rest connecting rod assembly is driven by the actuator to extend and the linkage rod drives the second connecting rod to move, the second connecting rod drives the backrest connector to tilt backwards, meanwhile, the locking device enters the guide groove from the open side of the guide groove and is guided to the locking groove by the guide groove, the two mechanical extension units and the base are locked to swing relatively, and the lying posture state is switched.

2. The mechanical extension device according to claim 1, wherein the guide groove is an upward-opening V-shaped groove, and an opening angle range of the guide groove is 120-150 degrees.

3. The mechanical extension device according to claim 2, wherein a wall of the guide groove is a guide surface configured to rock the two mechanical extension units relative to the base while being moved by the actuator, and the locking device is configured to move toward a locking slot without an obstruction.

4. The mechanical extension device according to claim 1, wherein upper ends of the first swinging rod and the second swinging rod are rotatably connected to the base, lower ends of the first swinging rod and the second swinging rod are rotatably connected to the two mechanical extension units, a front part of the two mechanical extension units is rotatably connected to the first swinging rod, and a rear part of the two mechanical extension units is rotatably connected to the second swinging rod; when the actuator is stopped and the two mechanical extension units swing relative to the base, the first swinging rod and the second swinging rod rotate in synchronization.

5. The mechanical extension device according to claim 1, wherein the base comprises a supporting seat and a substrate, the substrate is fixedly connected to the supporting seat, the substrate is provided with a first connecting portion and a second connecting portion located at a front end and a rear end, the first connecting portion is protruding towards a front upper side, the second connecting portion is protruding towards a back upper side, the first swinging rod is connected to an upper end portion of the first connecting portion in a rotating mode, the second swinging rod is connected to an upper end portion of the second connecting portion in the rotating mode, and the first swinging rod and the second swinging rod droop to a side of the substrate.

6. The mechanical extension device according to claim 5, wherein the guide groove and the locking groove are formed in the substrate, and are positioned between the first connecting portion and the second connecting portion and in a middle of the substrate; the locking device is located an upper end of the second connecting rod; and when a position of sitting switches to a position of lying, the second connecting rod rotates forward, and the locking device enters the guide groove.

7. The mechanical extension device according to claim 1, wherein the second connecting rod is rotatably connected to a seat connecting rod and a backrest connecting rod, a first end of the backrest connecting rod is rotatably connected to the second connecting rod, a second end of the backrest connecting rod is rotatably connected to a lower end part of the backrest connector, a lower end of the seat connecting rod is rotatably connected to the second connecting rod, and an upper end of the seat connecting rod is fixedly connected to the seat connector; when the second connecting rod rotates forwards, the backrest connecting rod drives the backrest connector to incline backwards relative to the seat connector, and the seat connecting rod drives the seat connector to descend; an upper end of the first connecting rod is fixedly connected to a front part of the seat connector, the seat connecting rod is fixedly connected to a rear part of the seat connector, and the first connecting rod and the seat connecting rod are configured to keep a height of the front part of the seat connector unchanged when the sitting posture state is switched to the lying posture state, and the seat connecting rod drives the rear part of the seat connector to sink.

8. The mechanical extension device according to claim 7, wherein the actuator is connected to the two mechanical extension units through a first driving pipe and a second driving pipe, the first driving pipe is connected to the leg rest connecting rod assembly, and the second driving pipe is connected to the seat connector.

9. The mechanical extension device according to claim 8, wherein the leg rest connecting rod assembly comprises a first leg connecting rod, a second leg connecting rod, a third leg connecting rod, and a fourth leg connecting rod, the first leg connecting rod is rotationally connected to the seat connector, a lower end of the first leg connecting rod is rotationally connected to a first end of the third leg connecting rod, a second end of the third leg connecting rod is rotationally connected to the footrest, a lower end of the second leg connecting rod is rotationally connected to a first end of the fourth leg connecting rod, a second end of the fourth leg connecting rod is rotationally connected to the footrest, and a lower part of the second leg connecting rod is also rotationally connected to the third leg connecting rod; a middle part of the first leg connecting rod is rotationally connected to the linkage rod; the first driving pipe is fixedly connected to the second leg connecting rod.

10. The mechanical extension device according to claim 1, wherein the base comprises a rotating base and a base plate, the rotating base comprises a rotating seat and a fixed seat, the rotating seat is rotatably arranged on the fixed seat, the base plate is fixedly arranged on the rotating seat, the first swinging rod and the second swinging rod are rotatably connected onto the base plate, and the two mechanical extension units are rotatably connected to the first swinging rod and the second swinging rod; a plurality of rolling balls are arranged between the rotating seat and the fixed seat, and surfaces opposing the rotating seat and the fixed seat are equipped with rolling grooves, the plurality of rolling balls are located in the rolling grooves, and the rotating seat rotates relative to the fixed seat through the plurality of rolling balls.

* * * * *